US006525253B1

(12) United States Patent
Kikuchi et al.

(10) Patent No.: US 6,525,253 B1
(45) Date of Patent: Feb. 25, 2003

(54) TRANSMISSION OF MUSICAL TONE INFORMATION

(75) Inventors: Takeshi Kikuchi, Hamamatsu (JP); Yuji Koike, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/337,958

(22) Filed: Jun. 22, 1999

(30) Foreign Application Priority Data

Jun. 26, 1998 (JP) ..... 10-180866

(51) Int. Cl.[7] ..... G10H 7/00

(52) U.S. Cl. ..... 84/601; 84/609; 84/645; 84/649

(58) Field of Search ..... 84/600, 601, 609–610, 84/645, 649–650

(56) References Cited

U.S. PATENT DOCUMENTS 5,744,741 A 4/1998 Nakajima et al.
5,977,468 A * 11/1999 Fujii ..... 84/609
6,022,223 A * 2/2000 Taniguchi et al. ..... 434/307 A
6,423,893 B1 * 7/2002 Sung et al. ..... 84/600

FOREIGN PATENT DOCUMENTS

JP 08-297491 11/1996
JP 10-79712 3/1998

* cited by examiner

*Primary Examiner*—Marlon T. Fletcher
(74) *Attorney, Agent, or Firm*—Morrison & Foerster LLP

(57) ABSTRACT

A musical tone information transmitting apparatus that can efficiently transmit musical tone information comprises: a device for inputting musical tone information; a plurality of processing units which jointly process the musical tone information from said input means in distributed processing; a packet generator for measuring an amount of said musical tone information distributedly processed by the plurality of processing units at a predetermined cycle, for extracting and packetizing a predetermined amount of the musical tone information into a first packet when the amount of the musical tone information is greater than the predetermined amount and for further packetizing next musical tone information after said predetermined cycle is lapsed from the time corresponding to the last musical tone information of said first packet; and a device for transmitting said packets generated by said packet generator.

8 Claims, 9 Drawing Sheets

TRANSMISSION OF MUSICAL TONE INFORMATION

This application is based on Japanese Patent Application HEI 10-180866, filed on Jun. 26, 1998, the entire contents of which are incorporated herein by reference.

BACKGROUND OF THE INVENTION a) Field of the Invention

This invention relates to transmission techniques, more particularly to transmission techniques for musical tone information.

b) Description of the Related Art

MIDI (Musical Instrument Digital Interface) standard is used in communications between electronic musical instruments. Electronic musical instruments having MIDI interfaces can be connected to other electronic musical instruments with MIDI cables. In other words, the electronic musical instruments can transmit MIDI data via MIDI cables to the others. For example, one electronic musical instrument transmits MIDI data containing information of music performance by a player, and the other electronic musical instrument can receive the MIDI data and sound the musical tone. It means that the performance with one electronic musical instrument enables other electronic musical instruments to sound in real-time.

Further, in a communications network of general-purpose computers, many kinds of information can be communicated. For example, one computer transmits information such as audio data (raw musical tone information), MIDI data, etc. to another computer via a communications network after storing the information in a storage device, such as a hard disk drive, connected to the computer. Another computer receives the information and stores it in its hard disk drive or the like. A general-purpose communications network is used only for communicating information and so its characteristics are different from those of MIDI.

The MIDI standard enables a real-time communication between the electronic musical instruments but is not suitable for a long distance communication and a communication among a multiplicity of nodes. On the other hand, the general-purpose communications network is suitable for a long distance communication and a communication among a multiplicity of nodes, but a real-time communication between the electronic musical instruments is not taken into the consideration.

Multimedia communication using the general-purpose communications network is prevailing. Audio data has relatively a large amount of data because the sampling frequency is set, for example, at 48 kHz. It is difficult to transmit sampled audio data in real-time, especially when a transmitting device has a low processing ability. In this case, reduction in an amount of audio data by culling some audio data may be considerable, though it will cause deterioration of sounds.

Also there is a case wherein audio data are compressed for fast transmission. In this case, it is difficult to transmit sampling audio data in real-time when the compression process takes long time.

SUMMARY OF THE INVENTION

An object of this invention is to provide an apparatus that can efficiently transmit musical tone information.

According to one aspect of this invention, there is provided a transmission apparatus comprising: a device which inputs musical tone information; a plurality of processing units which jointly process the musical tone information from said input device in distributed processing; a unit which distributes said musical tone information to said plurality of processing units to have the distributed musical tone information distributedly processed by the plurality of processing units; and a device which transmits said musical tone information processed by the plurality of processing units.

According to another aspect of this invention, there is provided a transmission apparatus comprising: a device which inputs musical tone information; a plurality of processing units which jointly process the musical tone information from said input device in distributed processing; a packet generator which measures an amount of said musical tone information distributedly processed by the plurality of processing units at a predetermined cycle, extracts and packetizes a predetermined amount of the musical tone information into a first packet when the amount of the musical tone information is greater than the predetermined amount, and further packetizes next musical tone information after said predetermined cycle is lapsed from the time corresponding to the last musical tone information of said first packet; and a device which transmits said packets generated by said packet generator.

As above, according to this invention, since the processing of the musical tone information is performed in distributed processing by distributing the information to the plurality of the processing units, load of each processing unit is reduced. A real-time processing of the musical tone information can be realized thereby. In addition, a quality of the musical tone information can be improved by increasing an amount of the musical tone information.

When an amount of the musical tone information, which is measured at the predetermined cycle, is greater than the predetermined amount, information of the predetermined amount is extracted and packetized. The next packetizing process is performed by measuring the amount of information after the predetermined cycle started from the time corresponding to the last musical tone information of said first packet. Since the starting time of said predetermined cycle depends on the amount of the musical tone information in the last packet, an efficient packet-transmission can be performed.

DESCRIPTION OF THE PREFERRED EMBODIMENTS

Figure 1:
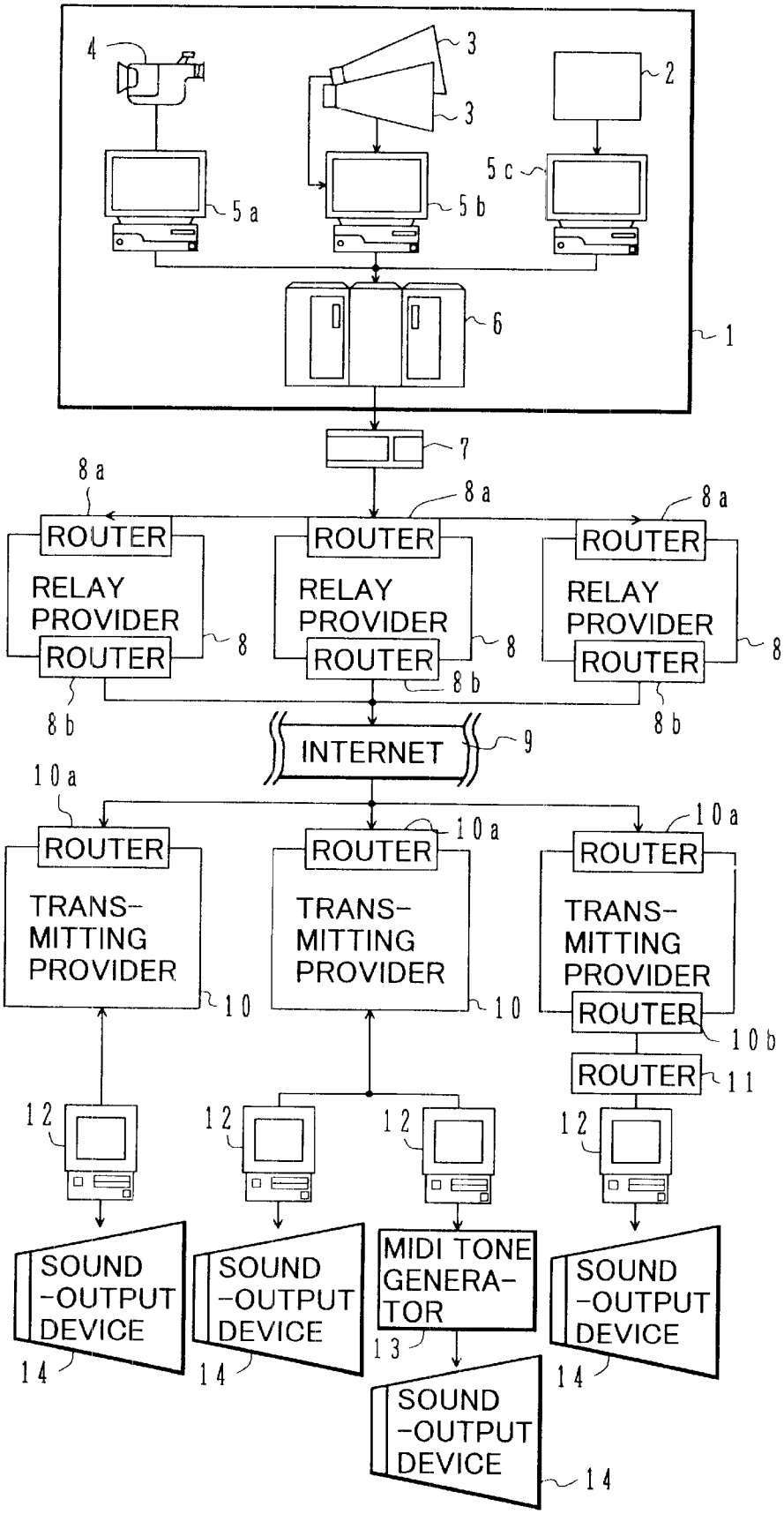
FIGS. 1 is a block diagram showing a configuration of a multimedia communications network.

FIG. 1 shows a configuration of a multimedia communications network.

In a concert hall 1 are a camera 4, microphones 3, a MIDI musical instrument 2, encoders 5*a*, 5*b*, and 5*c* and a transmitting server 6. In the concert hall 1, a player plays the MIDI musical instrument 2, and a singer sings along with the song to the microphone 3. Further, sound of acoustic drums, an acoustic piano and an acoustic guitar is picked up by the other microphones 3 placed near the musical instruments.

The microphones 3 generate an analog audio signal (a sound signal) from the voice of the singer, the sound of the drums, etc. and supply it to the encoder 5*b*. The encoder 5*b* converts the analog audio signal to digital audio data (sound data).

The MIDI musical instrument 2 generates MIDI data in accordance with a performance of the player and supplies the data to the encoder 5*c* in real-time. The camera 4 shoots scenes of the players and supplies the scenes to the encoder 5*a* as video data.

All of the encoders 5*a*, 5*b* and 5*c* or the one which is heavy loaded will have a distributed processing. For example, the encoder 5*b* has a plurality of encoders (computers) within and performs the distributed processing. The distributed processing improves a performance of the encoder 5*b* and enables an efficient real-time processing. The description of the process will be explained later with reference to FIGS. 2*a* to 2*c*.

The encoders 5*a*, 5*b* and 5*c* encode video data, audio data and MIDI data into packets having predetermined data formats, thereafter transmit the data to the transmitting server 6 in real-time. The formats of the packets will be explained later with reference to FIGS. 10*a* and 10*b*.

The transmitting server 6 transmits the packets to relay providers 8 via a router, 7, preferably in real-time. A time period for the preferred real-time transmission is less than 30 seconds, preferably 10 seconds, more preferably 5 seconds or further preferably 3 seconds, which is measured from the time the data from the camera 4, the microphones 3 and the MIDI musical instrument 2 are input into the encoders 5*a*, 5*b* and 5*c* to the time the transmitting server 6 transmits the packets corresponding to the data. For example, the data-buffering time is one to two seconds, and the encoding (e.g. compression) time and the packetizing time is several milliseconds. In case that the encoders 5*a*, 5*b* and 5*c* perform the packet generating process instead of the transmitting server 6, the time period should be measured from the time the data are input into the encoders 5*a*, 5*b* and 5*c* to the time the encoders transmit the packets corresponding to the data.

Further, for the preferred real-time transmission, it is preferable that the transmitting server 6 or the encoders 5*a*, 5*b* and 5*c* start the packet-transmission from the beginning to the end of the performance in the concert hall 1. That is, the transmitting server 6 or the encoders 5*a*, 5*b* and 5*c* preferably start the packet-transmission between the disclosure of the input data (preferably for one song) by the encoders 5*a*, 5*b* and 5*c* and the end of the data.

Furthermore, for the preferred real-time transmission, it is preferable that the transmitting server 6 or the encoders 5*a*, 5*b* and 5*c* start the packet-transmission of the input data without a human-generated transmission request. For example, it can not be considered as the real-time transmission if the encoders 5*a*, 5*b* and 5*c* store the input data in the hard disk drives unless given a request of an operating person for the transmission of the data with an input means such as a keyboard or a mouse. The real-time transmission is maintained by an automatic packet-transmission of the input data without the transmission request.

The relay providers 8, a plurality of which are configured, transmit the packets to an Internet line 9 by the distributed processing. Routers 8*a* administrate input of the relay providers 8, and routers 8*b* administrate output of the relay providers 8.

The Internet line 9, for example, is a telephone line or an exclusive line. Every one of a plurality of transmission providers 10 receives the packets via routers 10*a*, respectively, through the Internet line 9.

A home computer 12 can receive audio data, MIDI data, video data, etc. with a connection to the Internet. The home computer 12 has a display and a MID tone generator which is connected to an external sound-output device 14.

Images of the video data are shown on the display. The MIDI data are converted to a musical tone signal at the MIDI tone generator and sounded by the sound output device 14. The audio data are converted to digital data from analog data and sounded by the sound output device 14. With synchronizing the MIDI data and the audio data, the home computer 12 makes the sound output device sound musical tone corresponding to both data. Sound equivalent to sound and voice of a performance in the concert hall 1 is sounded by the sound output device 14 in real-time.

In addition, when the home computer 12 is connected to an external MIDI tone generator, the home computer 12 can make the MIDI tone generator generate an musical tone signal for sounding the sound with the sound output device 14.

It takes, for example, 30 seconds at most for the data transmitted by the router 7 to be received by the home computer 12. The home computer 12 receives the data continuously once it starts the reception. The home computer 12 reproduces the musical tone and displays the pictures in real-time based on the received data.

In a musical performance, MIDI data and audio data are more important information for users than video data. Therefore, processing of MIDI data and audio data has priority.to the processing of video data. Images based on the video data may be low in quality and small in number of frames, whereas a musical tone signal based on MIDI data and audio data is required to be of high quality. Although, in a sports broadcast, importance of video and audio is reversed.

The users can listen to singing voice and music in real-time while watching the pictures of the concert hall 1 through the display at home without going to the concert hall 1. Further, by connecting the home computer 12 to the Internet, anyone can listen to singing voice and music. For example, when a concert is held in the concert hall 1, an unspecified number of the public can enjoy the concert at their home.

Transmitting MIDI data to home can make up a condition similar to which performers are playing the electronic musical instruments at everyone's home. Transmission of MIDI data is not interfered with by any noises.

Figure 2A:
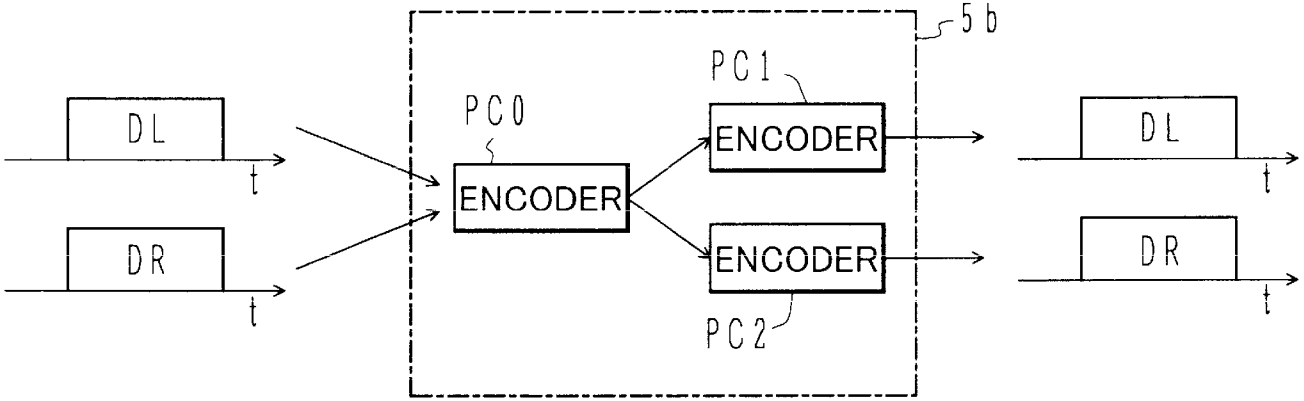
FIGS. 2A, 2B and 2C are block diagrams showing a structure of an encoder wherein a distributed processing of stereo channel data is performed.

FIGS. 2A shows a distributed processing performed at the encoder 5*b* shown in FIG. 1.

The encoder 5*b*, for example, comprises three encoders: PC0, PC1, and PC2. The microphones 3 (FIG. 1) supply stereophonic data, consisting of left-channel data DL and right-channel data DR, to the encoder PC0. The encoder PC0 converts the data DL and DR, from analog to digital, thereafter transmits the left-channel data DL to the encoder PC1 and the right-channel data DR to the encoder PC2.

The encoder PC1 compresses and packetizes the left-channel data DL, thereafter transmits the data DL to the transmitting server 6 (FIG. 1). The encoder PC2 compresses and packetizes the right-channel data DR, thereafter transmitting the data DR to the transmitting server 6 (FIG. 1).

As above, the encoder PC0 distributes the received audio data DL and DR to the encoders PC1 and PC2, which jointly perform the distributed processing of the audio data DL and DR. By performing the distributed processing, processing load of each of the encoders PC0, PC1 and PC2 is decreased.

When the encoder 5*b* is configured with one encoder, load of the encoder 5*b* will increase because the distributed processing can not be performed. In addition, the input data stored in a buffer in the encoder 5*b* sometimes overflows. Further, the processing of the data DL and DR may not be performed in real-time.

With the distributed processing of audio data, it is possible to process the data for two channels, the left-channel data DL and the right-channel data DR, and even for three or more channels. Channels may be set up for every part (vocals, musical instruments, etc.) in a musical performance.

Quality of sounds can be improved by increasing an amount of samples of the audio data DL and DR. Real-time processing of audio data can be performed, regardless of the number of the channels or the amount of samples, because the load of the encoders PC1 and PC2 are decreased by the distributed processing.

Figure 2C:
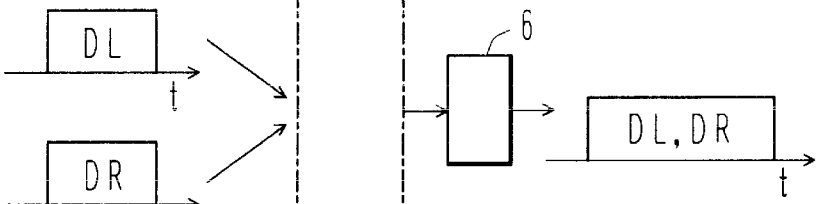
Figure 2B:
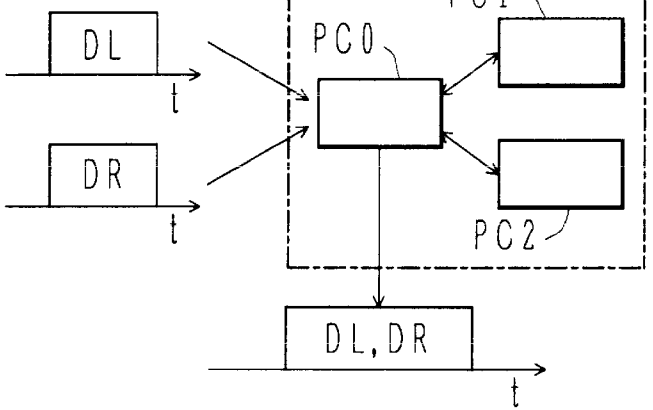

The encoders PC1 and PC2 do not have to perform the packetizing process. As shown in FIG. 2*b*, the encoder PC0 may packetize the data received from the encoders PC1 and PC2 and transmits the packets to the transmitting server 6 (FIG. 1). Similarly, as shown in FIG. 2*c*, the transmitting server 6 may packetize the data and transmit the packets. When the encoder PC0 or the transmitting server 6 packetizes the data, the data DL and DR may be packetized individually or uniformly.

Figure 3:
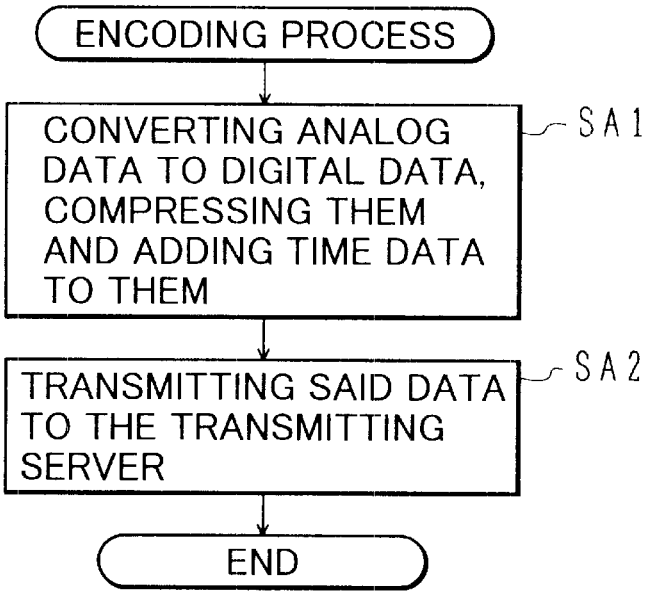
FIG. 3 is a flow chart illustrating an apparent process to be performed at the encoder.

FIG. 3 is a flow chart illustrating an apparent process to be performed at the encoder 5*b*.

At step SA1, the input analog data DL and DR are converted to digital data and compressed, and time data, etc. are added to the data. The time data represent the performance time and are added to every packet.

At step SA2, said data are packetized and transmitted to the transmitting server 6. Packetizing format will be described later with reference to FIG. 10A.

Figure 4:
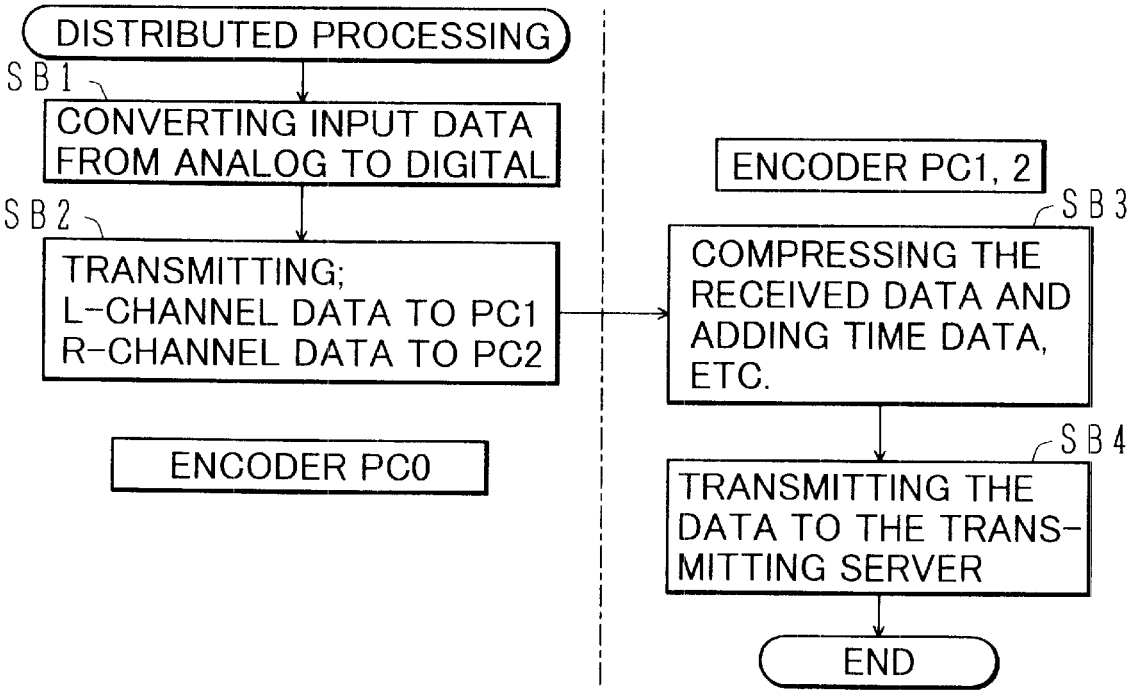
FIG. 4 is a flow chart illustrating a distributed processing to be performed at the encoder.

FIG. 4 is a flow chart illustrating the distributed processing to be performed at the encoder 5*b*. Left-hand side processes SB1 and SB2 are performed at the encoder PC0, and right-hand side processes SB3 and SB4 are performed at the encoders PC1 and PC2.

At step SB1, the encoder PC0 converts the input analog data DL and DR into digital data.

At step SB2, the encoder PC0 transmits the left-channel data DL to the encoder PC1 and the right-channel data to the encoder PC2.

At step SB3, each of the encoders PC1 and PC2 compresses the received data and adds the time data, etc.

At step SB4, each of the encoders PC1 and PC2 packetizes said data and transmits them to the transmitting server 6.

Figure 5:
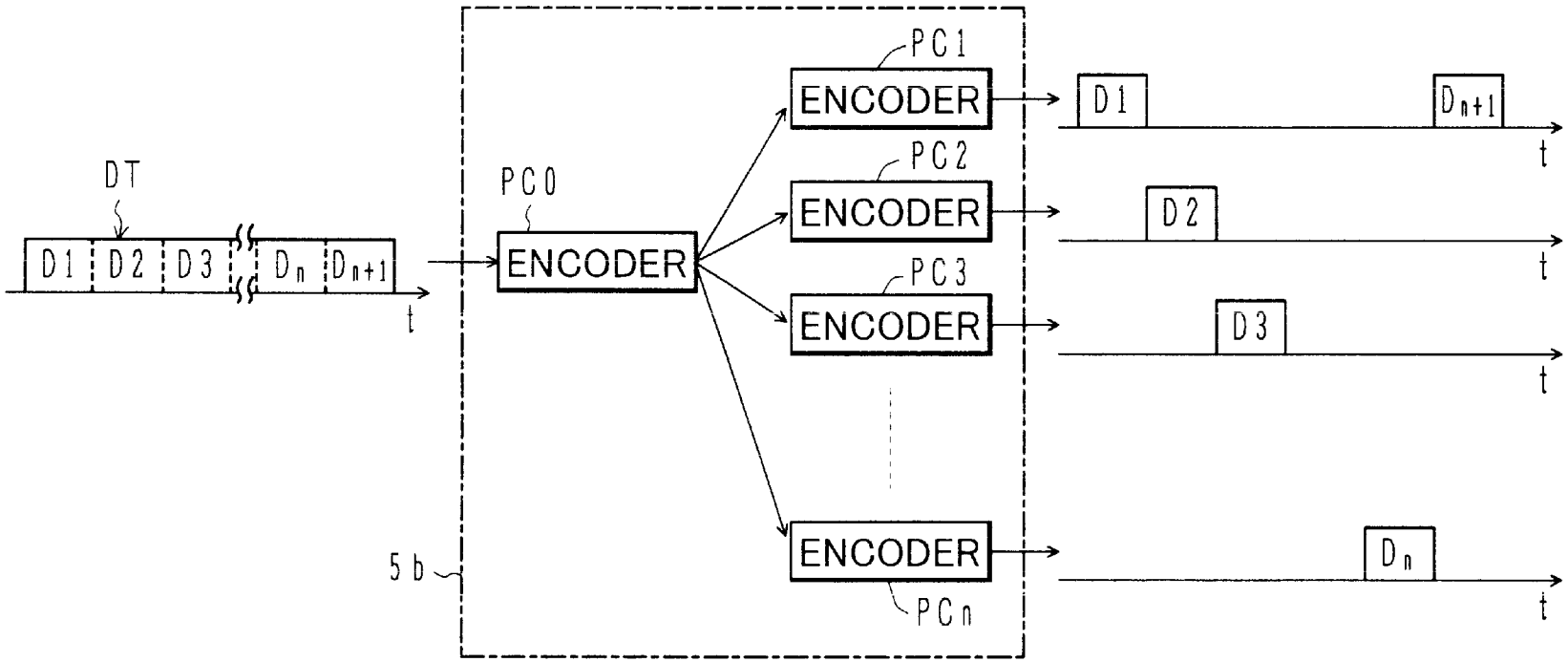
FIG. 5 is a block diagram showing an encoder wherein a time-sharing distributed processing is performed.

FIG. 5 shows another example of distributed processing at the encoder 5*b*. The encoder 5*b* comprises, for example, the number of n+1 encoders; PC0, PC1, PC2, PC3, . . . , PCn. Audio data DT are supplied to the encoder PC0 from the microphones 3 (FIG. 1).

The encoder PC0 converts the audio data DT from analog into digital. The encoder PC0 distributes the digital audio data DT to the encoders PC1 to PCn by time-sharing. For example, the audio data DT are divided into data D1, D2, D3, . . . , Dn, Dn+1 according to time series.

The encoders PC1 to PCn start a compression process at the time the data for a predetermined time interval are stored in the buffer, thereafter packetizes the compressed data and transmits them to the transmitting server 6 (FIG. 1).

Each of the encoders PC1 to PCn performs the process and transmits the data respectively; the data D1 at the encoder PC1, the data D2 at the encoder PC2, the data D3 at the encoder PC3, . . . , the data Dn at the encoder PCn. The next data Dn+1 are processed and transmitted by the encoder PC1 again.

As above, the encoder PC0 distributes the received audio data DT to the encoders PC1 to PCn by time-sharing. The audio data DT are processed by distributed processing at the encoders PC1 to PCn. The above distributed processing comprises the compression process, etc., and the packetizing process when necessary. By the distributed processing, each processing load of encoders PC1 to PCn is reduced. Therefore, the quality of sound can be improved by increasing the amount of samples, for example, by using high sampling frequency.

The distributed processing has been described in connection with the encoder 5*b* performing the audio data processing. However, the encoder 5*a*, which performs processing of video data, and the encoder 5*c*, which performs processing of MIDI data, can also perform the distributed processing similarly to the encoder 5*b*.

The encoder 5*a* can distribute the compression process of video data. For example, the encoder 5*a* can distribute the processing of video data into frames.

The encoder 5*c* divides MIDI data into a series of MIDI data according to time and measures time interval between each MIDI data in the series of MIDI data, thereafter adding time information about the time interval to the respective MIDI data. The above-described processing can be distributed. A piece or a series of MIDI data at a predetermined cycle is/are packetized. One packet will have one piece of time data (FIG. 3, step SA1). That piece of time data represents the performance time for MIDI data within a packet. Said time information added to each of MIDI data within the packet represents higher time resolution of performance time than said time data.

Figure 6:
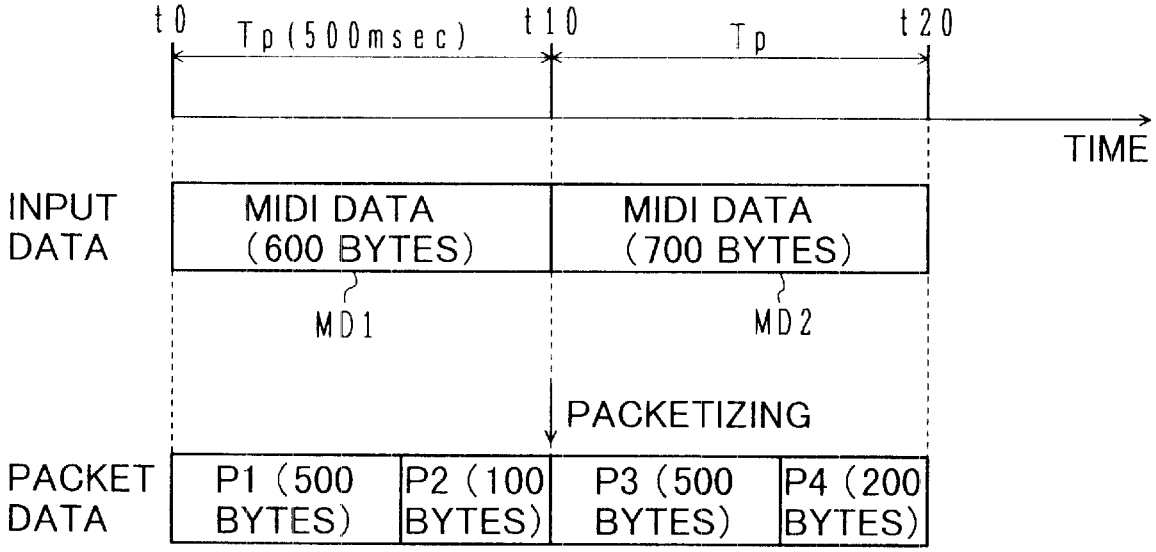
FIG. 6 is a time chart showing a first process of generating packets.

FIG. 6 shows a first process of generating packets of MIDI data. The MIDI data comprise Note On, Note Off, Program Change (sounds selection), etc., and an amount of the data for a unit of time is not constant.

The encoder 5*c* performs the process of generating packets of the input data MD1 and MD2 at a period Tp. The packet-generating period Tp is, for example, 500 ms. The MIDI data MIDI are data received in the period Tp from time t0 to t10 and are 600 bytes for example. The MIDI data MD2 are data received in the period Tp from time t10 to t20 and are 700 bytes for example.

The encoder 5*c* stores the input data MD1 and MD2 in the buffer therein and packetizes the data in the buffer at every period Tp. A data part within the packet is preferable to be about 500 bytes. Too many amounts of data increase transmission load. On the other hand, too small amount of data decreases efficiency of data transmission (increases overhead).

At first, the encoder 5*c* starts the packet-generating process at the time t10 after the period Tp elapsed from the time t0. An amount of the input data MD1 in the buffer is 600 bytes and so is exceeding 500 bytes. The encoder 5*c* divides the input data MD1 to generate two packets; P1 and P2. The packet P1 contains the first 500 bytes of the data MD1, and the packet P2 contains the remaining 100 bytes of the data MD 1. Both packets P1 and P2 have data parts of which amounts are 500 bytes or less than 500 bytes.

Next, the encoder 5*c* performs the packet-generating process at the time t20 after the period Tp elapsed from the time t10. An amount of the input data MD2 in the buffer is 700 bytes and so is exceeding 500 bytes. The encoder 5*c* divides the input data MD2 to generate two packets P3 and P4. The packet P2 contains the first 500 bytes of the data MD2, and the packet P4 contains the remaining 200 bytes of the data MD2.

According to the packet-generating process described above, an amount of data within the packet can always be kept at 500 bytes or less than 500 bytes. The encoder 5*c* transmits four packets P1 to P4.

Figure 7:
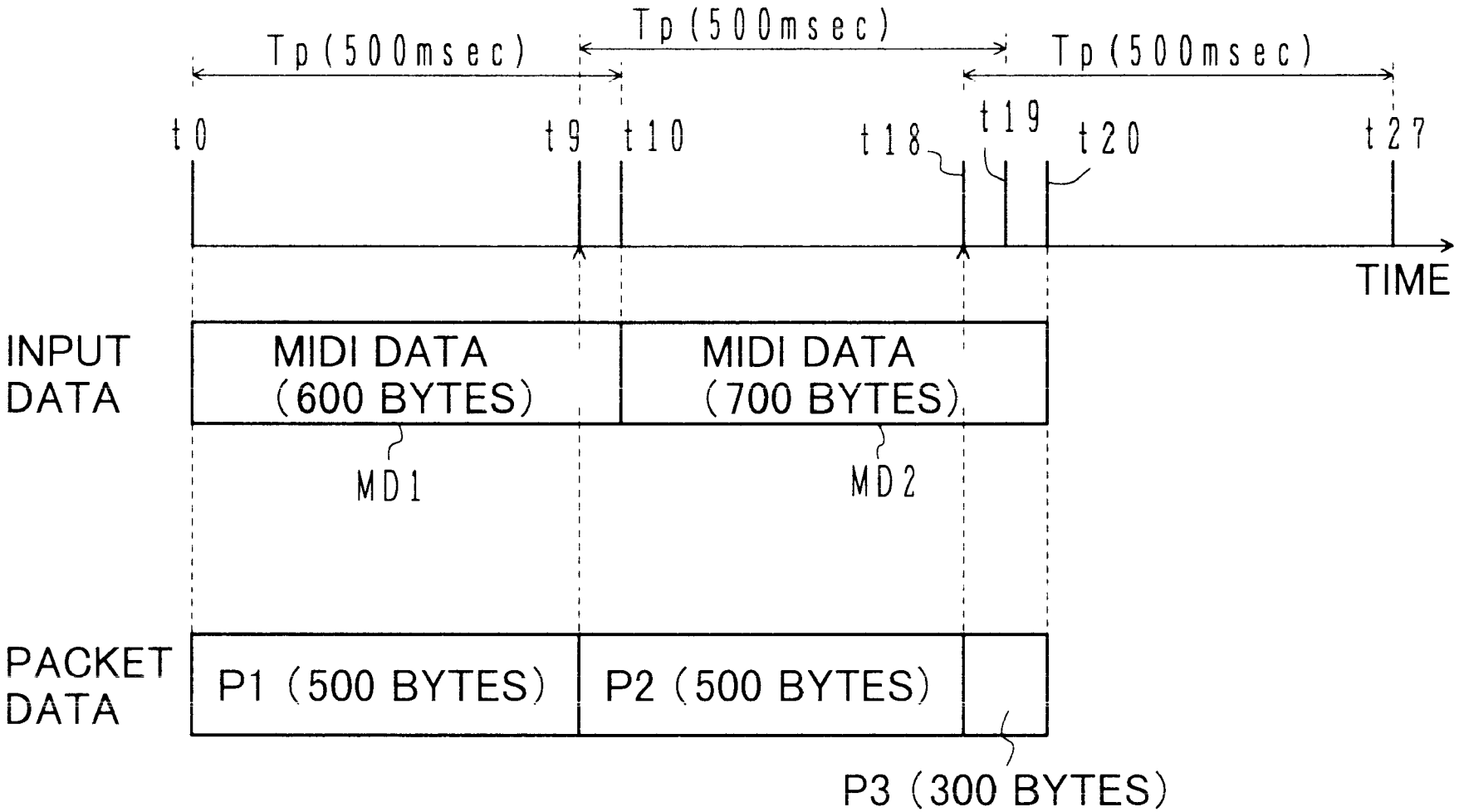
FIG. 7 is a time chart showing a second process of generating packets.

FIG. 7 shows a second process of generating packets of MIDI data. The encoder 5*c* controls a timing of a starting time of the period Tp to perform the packet-generating process of the input data MD1 and MD2 efficiently.

At first, the encoder 5*c* starts the packet-generating process at the time t10 after the period Tp elapsed from the time to. At the same time, a packet P1 is generated from the first 500 bytes of the 600 bytes input data MD1. An ending time t9 of 500 bytes data in that packet P1 will be a starting time of the next period Tp.

Two methods of acquiring the time t9 will be described. The first method will be described first. One unit of MIDI data (a MIDI event) commonly has one to three bytes of data. Every time MIDI data are input, the encoder 5*c* stores input times (preferably absolute times) of the data together with the MIDI data in the buffer. Then, after generating the packet PI, the encoder 5*c* acquires the input time, which will be the time t9, corresponding to the last data of the 500 bytes data in the packet P1.

In addition, said input time may be either absolute or relative times. The encoder 5*c* may acquire the time t9 by adding the time t0 and the difference obtained by subtracting the input time of first data from the time of last data of the 500 bytes data in the packet P1.

The second method will be described. Every time MIDI data are input, the encoder 5*c* stores present MIDI data in the buffer together with an interval time which is the difference obtained by subtracting an input time of previous MIDI data from an input time of the present MIDI data. Then, after generating the packet P1, the encoder 5*c* adds up all the interval times corresponding to the MIDI data inside the packet P1 and adds the sum to the time t0. Thereby, the time t9 can be acquired.

Next to said packet-generating process at the time t10; the encoder 5*c* starts the packet-generating process at the time t19 after the period Tp elapsed from the time t9. At the same time, a packet P2 is generated from the remainders of the 600 bytes input data MD1 stored in the buffer and the first 400 bytes of the input data MD2. The packet P2 contains the last 100 bytes of the input data MD1 and the first 400 bytes of the input data MD2. An ending time t18 of 500 bytes data in that packet P2 will be a starting time of the next period Tp.

Next, the encoder 5*c* starts the packet-generating process at the time t27 after the period Tp elapsed from the time t18. At the same time, a packet P3 is generated from the 300 bytes remainders of the input data MD2 stored in the buffer.

The ending time of the 300 bytes data in the packet P3 is a time t20. The starting time of the next period Tp may be either one of the time t20 or t27. When the period Tp starts from the time t20, it is possible to transmit the packets in small sizes. On the other hand, when the period Tp starts from the time t27, it is possible that the number of packets to be transmitted can be reduced.

According to the second packet-generating process (FIG. 7), the number of packets can be reduced to three packets, whereas the first packet-generating process (FIG. 6) generates four packets. According to the second packet-generating process, an efficient packet transmission can be performed by reducing the number of packets.

Furthermore, the above-described first and second packet-generating processes may be performed at the other encoders 5*a*, 5*b* or the transmitting server 6 (FIG. 1). Changing in the sampling frequency varies the amount of the audio data.

Figure 8:
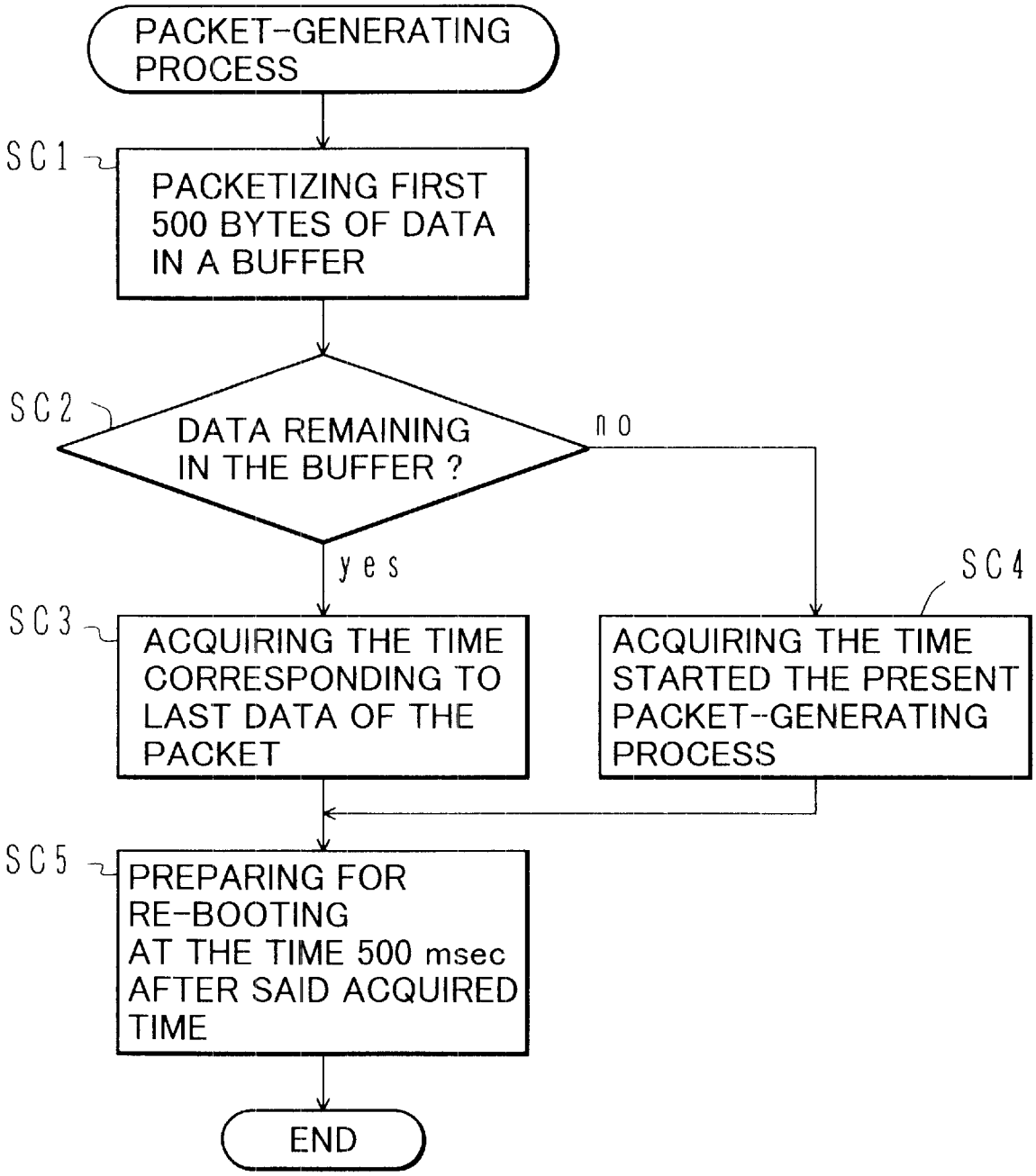
FIG. 8 is a flow chart showing the second process of generating the packet.

FIG. 8 is a flow chart showing the second packet-generating process.

At a step SC1, the first 500 bytes of the data in the buffer (e.g. MD 1) is packetized.

This buffer is a First-In First-Out buffer (FIFO), and so the data are deleted therefrom once hey are packetized.

At a step SC2, existence of remaining data in the buffer is checked. If there are the remaining data, then the next step will be a step SC3 as directed by an arrow with "YES" in the drawing. If not, the next step will be a step SC4 as directed by an arrow with "NO" in the drawing.

At the step SC3, the time (e.g. the time t9) corresponding to the last data of the packet is acquired before proceeding to a step SC5.

At the step SC4, the time (e.g. the time t27) when a present packet-generating process is started is acquired before proceeding to a step SC5.

Incidentally, the step SC2 may be followed by the step SC3 regardless of the remaining data in the buffer.

At the step SC5, this packetizing-process module (FIG. 8) is prepared to be rebooted at the time a period Tp (500 ms) passed from said acquired times.

Figure 9:
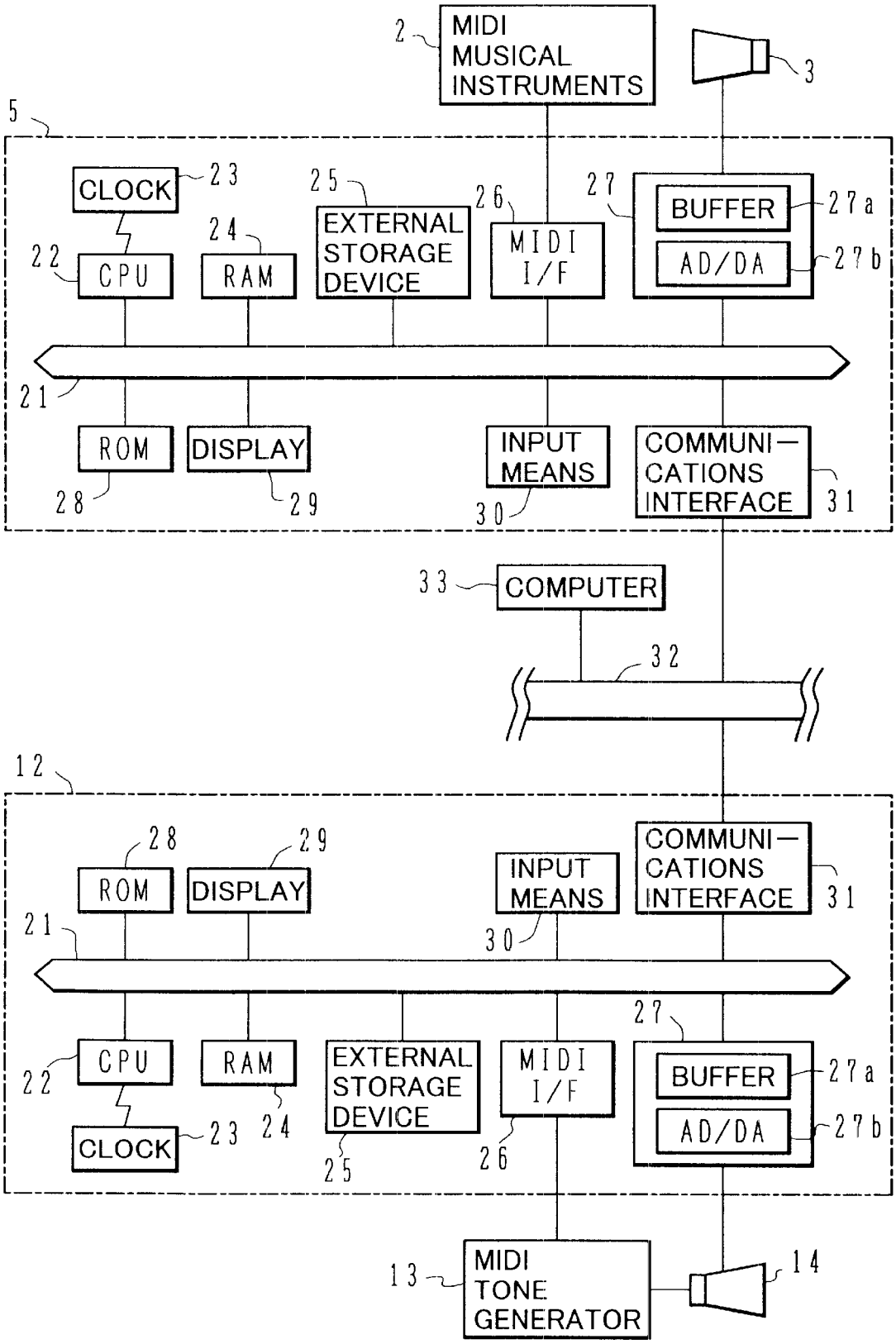
FIG. 9 is a block diagram showing the specific hardware structures of an encoder and a home computer.

FIG. 9 is a block diagram showing the specific hardware structures of an encoder (the encoders 5*a*, 5*b*, or 5*c*) and a home computer 12. A general-purpose computer or personal computer can be used for both encoder 5 and home computer 12.

The encoder 5 and the home computer 12 have equivalent structures. The structures of both are described next. Connected to a bus 21 are a CPU 22, a RAM 24, an external storage unit 25, a MIDI interface 25 for transmitting MIDI data to and from an external circuit, a sound card 27, a ROM 28, a display 29, an input means 30 such as a keyboard, a switch and a mouse, and a communication interface 31 for connection to the Internet.

The sound card 27 has a buffer 27*a* and a codec circuit 27*b* . The buffer 27*a* buffers data to be transmitted to and from an external circuit. The codec circuit 27*b* has an A/D converter and a D/A converter and can convert data between analog and digital data. The codec circuit 27*b* has also a compression/expansion circuit and can compress/expand data.

The external storage unit 25 may be a hard disk drive, a floppy disk drive, a CD-ROM drive, a magneto-optic disk drive or the like and can store MIDI data, audio data, video data, computer programs or the like.

ROM 28 can store computer programs and various parameters. RAM 24 has a working area for buffers, registers and the like and can store therein the contents copied from the external storage device 25.

CPU 22 executes various operations and processes in accordance with the computer programs stored in ROM 28 or RAM 24. A system clock 23 generates time information. CPU 22 can execute a timer interrupt process in response to the time information supplied from the system clock 23.

The communication interfaces 31 of the personal computer 12 and the encoder 5 are connected to the Internet line 32. The communication interfaces 31 are used for transmitting MIDI data, audio data, video data, computer programs, or the like to and from the Internet. The encoder 5 and the home computer 12 are connected via the Internet line 32.

First, the encoder 5 will be described. The MIDI instrument 2 is connected to the MIDI interface of the encoder 5*c* (FIG. 1) and the microphones 3 are connected to the sound card of the encoder 5*b* (FIG. 1). The MIDI instrument 2 generates MIDI data in accordance with a performance of a player and outputs the data to the MIDI interface 26. The microphones 3 pick up sounds at a concert hall and transmit analog audio signal to the sound card 27. The buffer 27*a* of the sound card 27 buffers the analog audio signal, and the codec circuit 27*b* converts the analog audio signal to digital audio data and compresses the digital audio data.

Next, the home computer 12 will be described. The MIDI interface 26 is connected to a MIDI tone generator 13, and the sound card 27 is connected to a sound output device 14. CPU 22 receives MIDI data, audio data, video data, computer programs, or the like from the Internet line 32 via the communication interface 31.

The communication interface 31 may be, in addition to an Internet interface, an Ethernet interface, an IEEE 1394 standard digital communication interface, or an RS-232C interface, and can be connected to various networks.

The encoder 5 stores computer programs to be executed for performing the distributed processing, transmitting the packet, etc. The personal computer 12 stores computer programs that are used for reception, reproduction, and other processes of audio data. By loading computer programs, various parameters, etc., which are stored in the external storage unit 25, into RAM 24, addition, version-up, etc. of computer programs and the like can be easily performed.

A CD-ROM (compact disk read-only memory) drive is a device for reading computer programs and the like stored in a CD-ROM. The read computer programs and the like are stored in a hard disk. In this manner, new installation, version-up and the like of computer programs can be easily performed.

The communication interface 31 is connected to the communications network 32 such as LAN (local area network), Internet and telephone line, and to a computer 33 via that communications network 32. When computer programs and the like are not stored in the external storage unit 25, they can be downloaded from the computer 33. The encoder 5 or the home computer 12 transmits a command for requesting download of computer programs or the like to the computer 33 via the communications network 32. Upon reception of this command, the computer 33 distributes the requested computer programs or the like to the encoder 5 or the home computer 12 via the communications network 32. The encoder 5 or the home computer 12 receives the computer programs or the like via the communication interface 31 and stores them in the external storage unit 25 to complete the download.

The embodiments may be reduced in practice by a commercially available personal computer or the like which is installed with computer programs realizing the functions of the embodiments. In this case, such computer programs or the like may be distributed to users by storing them in a computer readable storage medium such. as a CD-ROM, a floppy disk, etc. If such personal computers are connected to the communications network such as LAN, Internet, telephone line, etc., computer programs and various data may be distributed to the personal computers via the communications network.

Further, an electronic musical instrument, a video game system, a karaoke system, a TV set, etc. other than a personal computer may be used as the encoder 5 and the home computer 12.

Figure 10A:
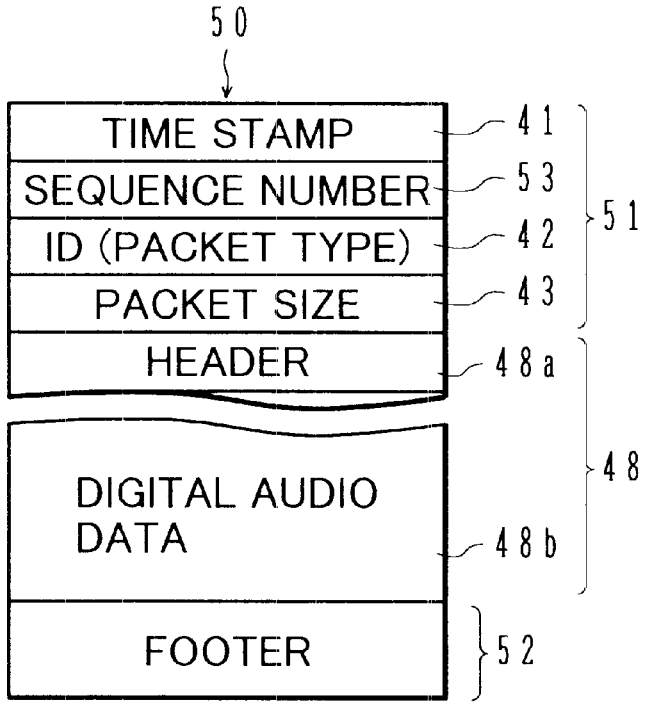
FIGS. 10A and 10B show structures of an audio data packet and a MIDI data packet.

FIG. 10A shows a structure of an audio data packet 50 transmitted by the encoder 5*b*.

The audio data packet 50 has a audio packet header 51, audio data 48 and a footer 52. The audio packet header 51 has a time stamp 41 representing time information, a sequence number 53 showing an order of a packet, an identification flag (ID) 42 showing that the packet contains audio data, and a size 43 of the packet.

The time stamp 41 shows a performance time and the recording/playing time as well as a transmission time of the audio data in the packet. The encoder 5*b* generates the time stamp 41 in accordance with the time information generated by its own system clock.

The identification flag 42 can represent a type of a packet; an audio data packet, a MIDI data packet, a video data packet, etc. In this example shown in FIG. 10A) the audio data 48 are transmitted and, therefore the identification flag 42 represents the audio data packet.

The audio data 48 contains audio data 48*b* and an audio data header 48*a* having information about a sampling frequency and a compression mode. The audio data 48*b* are data generated by the microphones 3 (FIG. 1 and FIG. 9), thereafter being converted from analog into digital and being compressed.

The footer 52 has data representing the end of the data. Check-sum may be included in the audio packet header 51 or the footer 52. The check-sum may be the sum of the amount of the audio data 48. In this case, the encoder 5*b* calculates the sum and adds it as the check-sum into the packet. The home computer 12 calculates the sum and checks it against the check-sum to confirm that there are no errors in communications.

Figure 10B:
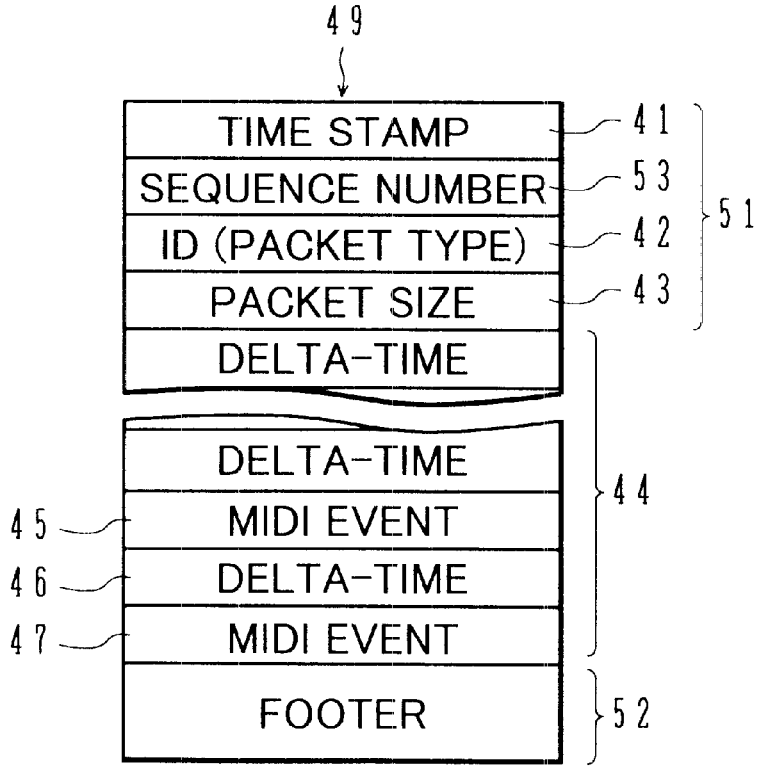

FIG. 10B shows a structure of a MIDI data packet 49 transmitted by the encoder 5*c*. The MIDI data packet 49 has a MIDI header 51, MIDI data 44, and a footer 52.

The MIDI header 51, similarly to the audio packet header 51 of the audio data packet, has a time stamp 41, a sequence number 53, an identification flag (ID) 42 showing that the packet contains MIDI data, and a size 43 of the packet.

The MIDI data 44 are based on the standard MIDI file format and are a sequence of a pair of delta-time (interval) and a MIDI event. The delta-time represents a time interval between present and last MIDI data. The delta-time may be omitted when its value is zero.

A video data packet has a packet structure similar to the structure of the audio data packet. In this case, the identification flag shows that the packet contains video data.

As above, the encoders 5*a*, 5*b*, and 5*c* performs the distributed processing to reduce the processing load of real-time processing of video data, audio data, and MIDI data. Therefore, the quality of sounds or the likes can be improved by increasing sampling frequency or the like of audio data.

Processing of musical tone information is especially preferred as a target of the distributed processing. The musical tone information may be audio data, MIDI data or the likes. The processing of musical tone information may be a process for compression, adding time information, or generating packet.

Moreover, in the packet-generation process, as shown in FIG. 7, the number of packets can be reduced by adjusting the starting time of the period Tp according to the amount of the data in the buffer, thereby reducing the packet transmission load.

Further, this invention is not limited only to the case that audio data, MIDI data, or the likes are transmitted via the Internet. Communications are not limited only to the Internet, but other serial or parallel communications may be used. For example, IEEE 1394 digital serial communications, a communications satellite, etc. may be used.

This invention has been described in connection with the preferred embodiments. The invention is not limited only to the above embodiments. It will be apparent to those skilled in the art that various modifications, improvements, combinations, and the like can be made.

What is claimed is:

1. A transmission apparatus for musical tone information comprising:

a device which inputs musical tone information;

a plurality of processing units which jointly process the musical tone information from said input device in distributed processing, each of said processing units comprising a central processing unit (CPU);

a distributing unit which distributes said musical tone information to said plurality of processing units to have the distributed musical tone information distributedly processed by the plurality of processing units; and a device which transmits said musical tone information processed by the plurality of processing units.

2. A transmission apparatus for musical tone information comprising:

an inputting device which inputs musical tone information;

a packet generator which stores said musical tone information input by the inputting device, generates a first packet by packetizing a predetermined amount of the musical tone information at a first time, acquires a second time represented by time data corresponding to last musical tone information in said first packet in time sequence, and sets a third time that a predetermined period elapses from the acquired second time, wherein the third time serves as start time of generating a second packet next to the first packet; and a device which transmits said first packets generated by said packet generator.

3. A transmission apparatus for musical tone information comprising:

means for inputting musical tone information;

a plurality of means for jointly processing the musical tone information from said input means in distributed processing, each of said plurality of processing means comprising a central processing unit (CPU);

means for distributing said musical tone information to said plurality of processing means to have the distributed musical tone information distributedly processed by the plurality of processing means; and means for transmitting said musical tone information processed by the plurality of processing means.

4. A transmission apparatus for musical tone information comprising:

means for inputting musical tone information;

packetizing means for storing said musical tone information input by the input means, generating a first packet by packetizing a predetermined amount of the musical tone information at a first time, acquiring a second time represented by time data corresponding to last musical tone information in said first packet in time sequence, and setting a third time that a predetermined period elapses from the acquired second time, wherein the third time serves as start time of generating a second packet next to the first packet; and means for transmitting said first packets generated by said packetizing means.

5. A transmission method for musical tone information comprising the steps of:

inputting musical tone information;

distributing said musical tone information to a plurality of processing units, each of which compromises a central processing unit (CPU);

processing the musical tone information by the plurality of processing units in distributed processing; and transmitting said musical tone information processed by the plurality of processing units.

6. A transmission method for musical tone information comprising the steps of:

inputting musical tone information;

storing said musical tone information input at the inputting step, generating a first packet by packetizing a predetermined amount of the musical tone information at a first time, acquiring a second time represented by time data corresponding to last musical tone information in said first packet in time sequence, and setting a third time that a predetermined period elapses from the acquired second time, wherein the third time serves as start time of generating a second packet next to the first packet; and transmitting said first packets generated by said packetizing step.

7. A storage medium for a program that a computer executes to realize a communication protocol comprising the steps of:

inputting musical tone information;

distributing said musical tone information to a plurality of processing units, each of which comprises a central processing unit (CPU);

processing the musical tone information by the plurality of processing units in distributed processing; and transmitting said musical tone information processed by the plurality of processing units.

8. A storage medium for a program that a computer executes to realize a communication protocol comprising the steps of:

inputting musical tone information;

storing said musical tone information input at the inputting step, generating a first packet by packetizing a predetermined amount of the musical tone information at a first time, acquiring a second time represented by time data corresponding to last musical tone information in said first packet in time sequence, and setting a third time that a predetermined period elapses from the acquired second time, wherein the third time serves as start time of generating a second packet next to the first packet; and transmitting said first packets generated by said packetizing step.

* * * * *